US010744619B1

(12) United States Patent
Boutorine

(10) Patent No.: US 10,744,619 B1
(45) Date of Patent: Aug. 18, 2020

(54) COMPACT ANGLE REFERENCE APPARATUS FOR SHARPENING BLADES

(71) Applicant: Oleg Boutorine, Brooklyn, NY (US)

(72) Inventor: Oleg Boutorine, Brooklyn, NY (US)

( * ) Notice: Subject to any disclaimer, the term of this patent is extended or adjusted under 35 U.S.C. 154(b) by 0 days.

(21) Appl. No.: 16/573,980

(22) Filed: Sep. 17, 2019

(51) Int. Cl.

| | |
|---|---|
| ***B24B 3/54*** | (2006.01) |
| ***B24B 41/06*** | (2012.01) |
| ***B24D 15/02*** | (2006.01) |
| ***B24D 15/06*** | (2006.01) |
| ***B24D 15/08*** | (2006.01) |

(52) U.S. Cl.
CPC ..... *B24B 41/066* (2013.01); *B24B 3/54* (2013.01); *B24D 15/02* (2013.01); *B24D 15/065* (2013.01); *B24D 15/081* (2013.01)

(58) Field of Classification Search
CPC ..... B24B 3/54; B24B 41/06; B24B 41/066; B24D 15/02; B24D 15/06; B24D 15/065; B24D 15/08; B24D 15/081; B24D 15/084
USPC ..... 451/552, 555, 556, 558
See application file for complete search history.

(56) References Cited

U.S. PATENT DOCUMENTS

| | | | | |
|---|---|---|---|---|
| 455,418 A * | 7/1891 | Sweeney et al. | B24B 47/06 | 451/213 |
| 2,798,344 A * | 7/1957 | Hertel | B24D 15/10 | 451/556 |
| 4,094,106 A * | 6/1978 | Harris | B24D 15/06 | 451/555 |
| 4,197,677 A * | 4/1980 | Graves | B24D 15/06 | 451/555 |
| 4,736,544 A * | 4/1988 | Greenquist | B24B 3/365 | 451/124 |
| 5,525,095 A * | 6/1996 | Baughman | B24B 27/02 | 125/11.03 |
| 5,810,649 A * | 9/1998 | Oar | B24D 15/06 | 451/278 |
| 6,048,262 A * | 4/2000 | Ray | B24D 15/08 | 451/524 |
| 6,123,611 A * | 9/2000 | Lawrence, Jr. | B24B 41/06 | 451/312 |
| 7,264,540 B1 * | 9/2007 | Brantley | B24B 3/54 | 451/194 |
| 8,262,438 B1 * | 9/2012 | Allison | B24D 15/08 | 451/321 |
| 8,439,727 B1 * | 5/2013 | Woodard | B24B 27/02 | 451/349 |
| 9,033,771 B2 * | 5/2015 | Krent | B24D 15/08 | 451/540 |
| 10,131,028 B1 * | 11/2018 | Allison | B24B 3/543 | |

(Continued)

*Primary Examiner* — Eileen P Morgan
(74) *Attorney, Agent, or Firm* — Changi Wu; Changi Wu Law Office

(57) ABSTRACT

A compact angle reference apparatus comprises one angle guide; and a base; wherein the one angle guide can be disposed on the base; wherein the base can be disposed on a surface adjacent to a sharpening tool; wherein the one angle guide further comprises a frame having an insert side and a hinge side, a lid having a guide surface, an insert end, and a hinge end opposite to the insert end, a set of hinge pins connecting the hinge side of the frame and the hinge end of the lid in a rotatable manner, an insert having a predetermined height, wherein the insert is movable, wherein the insert is configured to be erected between the insert end of the lid and the insert side of the frame, wherein the lid and the frame can form an angle by the predetermined height of the insert.

10 Claims, 4 Drawing Sheets

(56) References Cited

U.S. PATENT DOCUMENTS

| | | | | |
|---|---|---|---|---|
| 2006/0211348 | A1* | 9/2006 | Hyde | B24B 3/38<br>451/367 |
| 2007/0243799 | A1* | 10/2007 | Fuchs | B24B 3/54<br>451/45 |
| 2007/0281594 | A1* | 12/2007 | Jones | B24B 3/36<br>451/367 |
| 2012/0108145 | A1* | 5/2012 | Deppeler | B24B 3/605<br>451/9 |
| 2014/0335765 | A1* | 11/2014 | Allison | B24B 3/54<br>451/45 |
| 2019/0366500 | A1* | 12/2019 | Brewer | B24B 3/546 |

* cited by examiner

COMPACT ANGLE REFERENCE APPARATUS FOR SHARPENING BLADES

CROSS-REFERENCE RELATED TO RELATED APPLICATIONS

None.

BACKGROUND

For sharpening knives, it is very important to keep a constant angle at which blade contacts sharpening device. Changing angle will result in mis-sharpening or damaging blade edge. Sharpening stones may have integrated angle guides, such as disclosed, for example, in U.S. Pat. Nos. 4,094,106; 4,197,677; 6,048,262; and 9,033,771. However, different knives have different shapes and need to be sharpened at different angles between the knife blade surface and the surface of the sharpening tool. Those disclosed sharpening guides or sharpening tools with angle guides have fixed guide angles. Therefore, a user will need multiple sharpening tools with different angles when the user has different knife blades to be sharpened.

Another issue of the disclosed sharpening tools with fixed angle guide is that their angle guides cannot be repositioned to another section of the sharpening tool when the section of the sharpening tool adjacent to the fixed angle guide has been worn out. Thus, the sharpening tools with fixed angle guide are inconvenient, cost-ineffective, and need large spaces to store multiple sharpening tools.

Furthermore, a sharpening tool, such as a sharpening stone, maybe in different height or be held by holders that have different height. An angle guide is best to be at the same level as the sharpening surface of the sharpening tool. Therefore, it is inconvenient as the traditional angle guide that has a fixed height.

BRIEF SUMMARY OF THE INVENTION

This Brief Summary is included so as to introduce, in an abbreviated form, various topics to be elaborated upon below in the Detailed Description. This Brief Summary is not intended to identify key or essential aspects of the claimed invention. This Brief Summary is similarly not intended for use as an aid in determining the scope of the claims. The current invention is directed to a compact angle reference apparatus for sharpening a blade on a sharpening surface of a sharpening tool comprises one angle guide; and a base; wherein the one angle guide can be disposed on the base; wherein the base can be disposed on a surface adjacent to the sharpening tool; wherein the compact angle reference apparatus is substantially stationary to the sharpening surface when the blade is moved on the sharpening surface; wherein the one angle guide further comprises a frame having an insert side and a hinge side, a lid having a guide surface, an insert end, and a hinge end opposite to the insert end, a set of hinge pins connecting the hinge side of the frame and the hinge end of the lid in a rotatable manner, an insert having a predetermined height, wherein the insert is movable, wherein the insert is configured to be erected between the insert end of the lid and the insert side of the frame, wherein the lid and the frame can form an angle between about 0 degrees and 89 degrees by the predetermined height of the insert; and wherein the blade can be placed on the guide surface of the angle guide.

BRIEF DESCRIPTION OF THE DRAWINGS

It should be understood that the drawings are merely representative, are not necessarily drawn to scale, and are not intended to limit the subject matter of this application.

DETAILED DESCRIPTION

Figure 1:
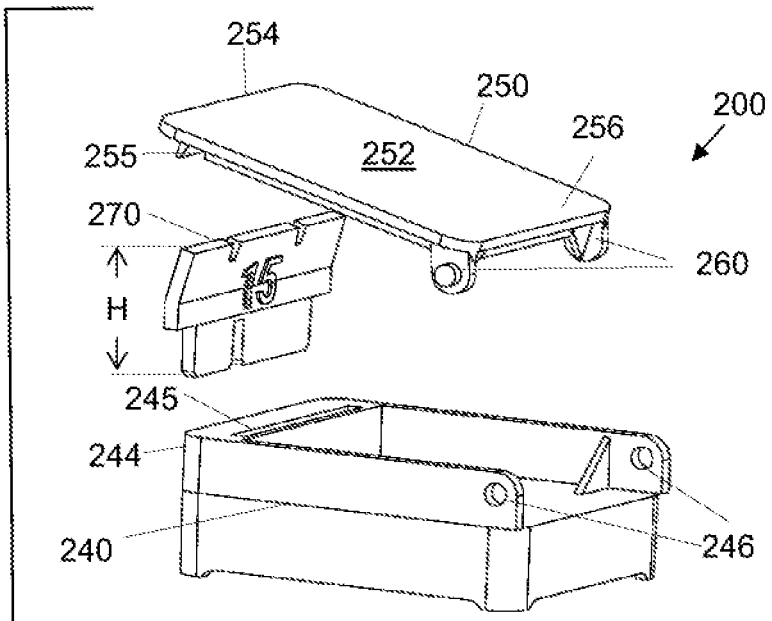
FIG. 1 is a perspective, exploded view of one preferred embodiment of an angle guide.

Before the present invention is described in greater detail, it is to be understood that this invention is not limited to particular embodiments described, and as such may, of course, vary. It is also to be understood that the terminology used herein is for the purpose of describing particular embodiments only, and is not intended to be limiting since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Other than in the embodiment or example, or where indicated otherwise, all numbers indicating ingredient quantities and/or reaction conditions are to be understood as being modified in every instance by the word "about," which means the ingredient quantities or reaction conditions are within 10 percent to 15 percent of the indicated value.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described. Any and all publications mentioned herein are incorporated herein by reference to disclose and describe the methods and/or materials in connection with which the publications are cited. It is understood that the present disclosure supersedes any disclosure of an incorporated publication to the extent there is a contradiction.

It must be noted that as used herein and in the appended claims, the singular forms "a", "an", and "the" may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Figure 2:
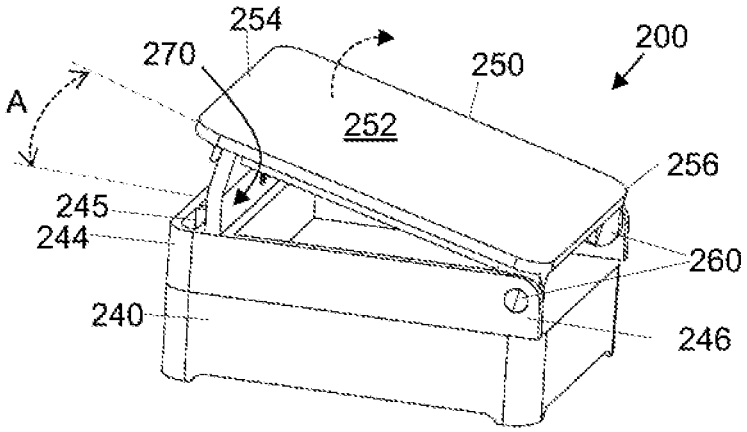
FIG. 2 is a perspective view of one preferred embodiment of an angle guide.
Figure 7:
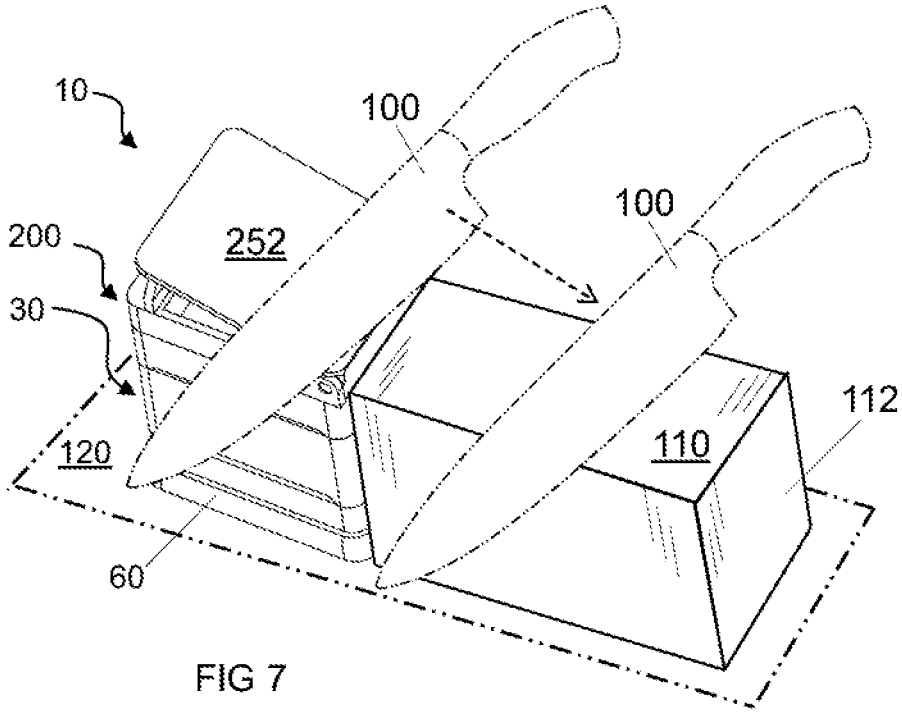
FIG. 7 is a perspective view of one preferred embodiment of a compact angle reference apparatus next to a sharpening tool.

As shown in FIG. 1, FIG. 2, and FIG. 7, one preferred embodiment of a compact angle reference apparatus 10 for sharpening a blade 100 on a sharpening surface 110 of a sharpening tool 112 comprises one angle guide 200; and a base 30; wherein the one angle guide 200 can be disposed on the base 30; wherein the base 30 can be disposed on a surface 120 adjacent to the sharpening tool 112; wherein the compact angle reference apparatus 10 is substantially stationary to the sharpening surface 110 when the blade 100 is moved on the sharpening surface 110; wherein the one angle guide 200 further comprises a frame 240 having an insert side 244 and a hinge side 246, a lid 250 having a guide surface 252, an insert end 254, and a hinge end 256 opposite to the insert end 254, a set of hinge pins 260 connecting the hinge side 246 of the frame 240 and the hinge end 256 of the lid 250 in a rotatable manner, an insert 270 having a predetermined height H, wherein the insert 270 is configured to be erected between the insert end 254 of the lid 250 and the insert side 244 of the frame 240, wherein the lid 250 and the frame 240 can form an angle A between about 0 degrees and 89 degrees by the predetermined height of the insert 270; and wherein the blade 100 can be placed on the guide surface 252 of the angle guide. The insert 270 can have various heights H. The configuration of the set of hinge pins 260 and the hinge side 246 is only one example to make the lid 250 connected to the frame in a rotatable manner.

As shown in FIGS. 1, 2, 3, and 3A, in one preferred embodiment of the invention, a slot is formed on the insert side 244 of the frame 240 and another one slot 255 is formed on the insert end 254 of the lid 250. The insert 270 can be inserted into the slot 245 and the slot 255 so that the insert 270 is erected from the insert side 244 of the frame 240 to support the insert end 254 of the lid 250. Since the hinge end 256 of the lid 250 is hinged by the set of hinge pins 260 in a rotatable manner, the lid 250 will form an angle A from the frame 240. As a result of using the insert 270 of a different height H, the angle guide will be able to form various angles to create different sharpening angles without replacing angle guides. Therefore, the invention is compact, innovative, and superior to the other types of angle guides. The height H may be any values depending on the size of the angle guide, but preferable from about a tenth of a centimeter to ten centimeters.

The configuration to make the insert 270 erected between the frame 240 and the lid 250 may not be limited to slots. A preferred embodiment of the insert may optionally have an angle mark 271, printed, engraved, or molded, to show the predetermined angle A as a result of the predetermined height H for a user's easy recognition of the degree of the angle guide. A person having ordinary skill in the art will appreciate other methods and mechanical configurations to achieve the same desired results.

Figure 3:
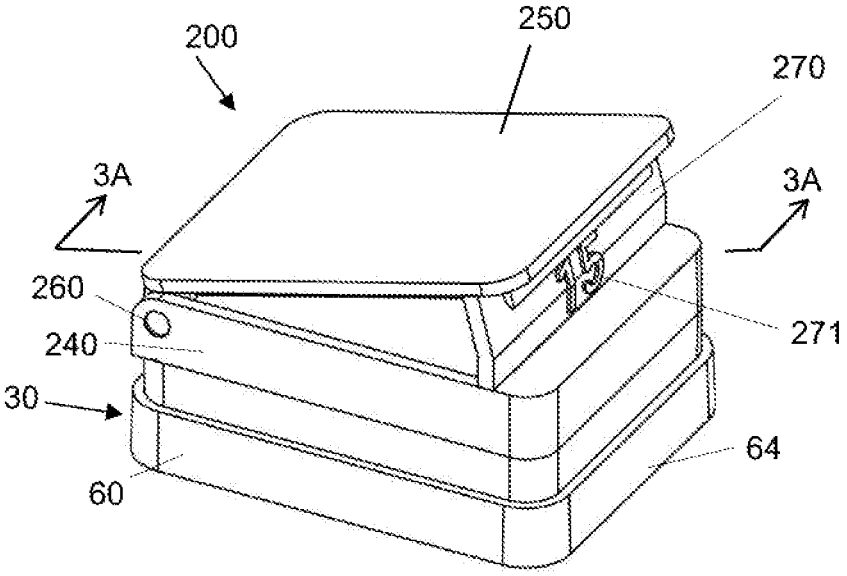
FIG. 3 is a perspective view of one preferred embodiment of an angle guide and a base.
Figure 3A:
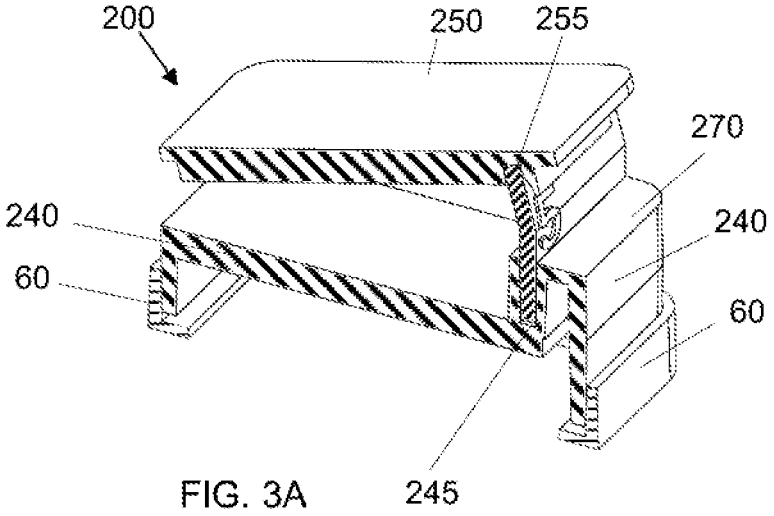
FIG. 3A is a sectional view of one preferred embodiment of an angle guide and a base.
Figure 4:
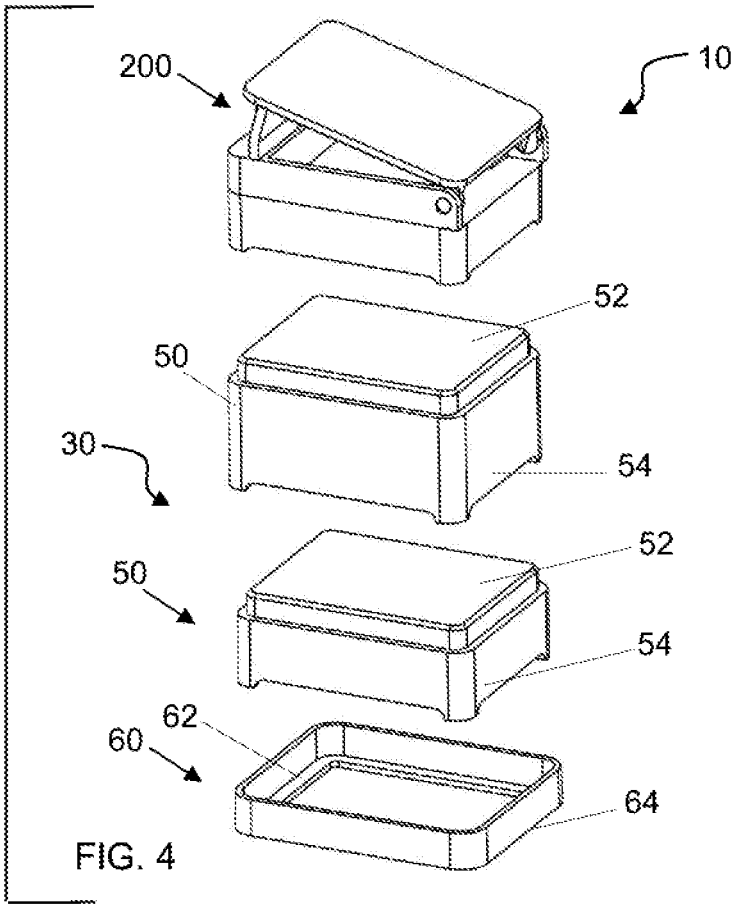
FIG. 4 is a perspective, exploded view of one preferred embodiment of a compact angle reference apparatus comprising one angle guide, two stands, and one shoe.

As shown in FIG. 3, FIG. 4 and FIG. 7, in a preferred embodiment, the base 30 of a compact angle reference apparatus 10 may comprise a shoe 60, wherein the shoe 60 further comprises a top 62 and a bottom 64 opposite to the top 62, wherein the shoe 60 can be disposed on a surface 120 adjacent to the sharpening tool 112. In one preferred embodiment, the shoe 60 comprises an anti-slip material, such as, but not limited to, rubbers, silicones, abrasives, and soft plastics. The anti-slip material can prevent the compact angle reference apparatus from moving when a blade 100 is placed against the guide surface 252 of the angle guide 200. Furthermore, the compact angle reference apparatus 10 is not fixed on the sharpening surface; therefore, it is convenient for the user to reposition the compact angle reference apparatus 10 around sharpening tool or to another sharpening surface.

Figure 5:
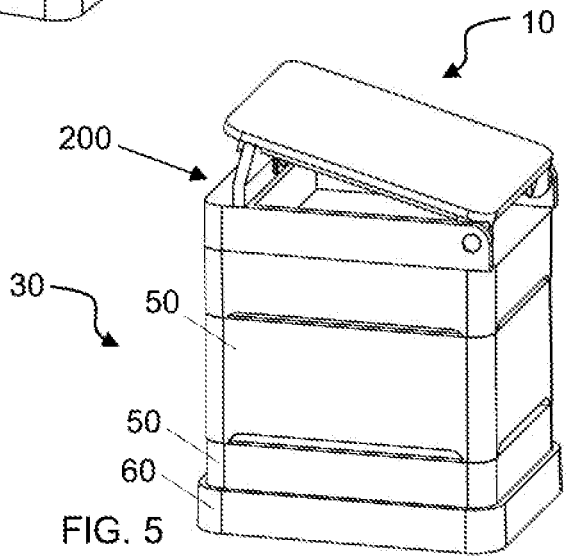
FIG. 5 is a perspective view of one preferred embodiment of a compact angle reference apparatus comprising one angle guide, two stands, and one shoe.
Figure 6:
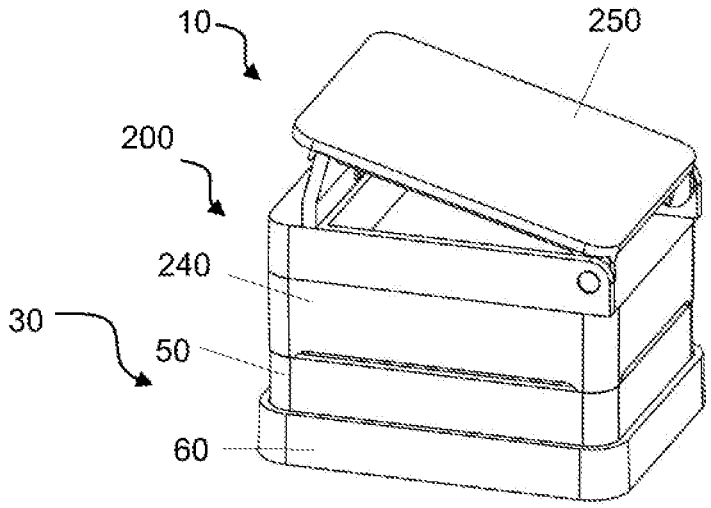
FIG. 6 is a perspective view of one preferred embodiment of a compact angle reference apparatus.

As shown in FIG. 4 and FIG. 5, in one preferred embodiment of the compact angle reference apparatus 10, wherein the base 30 further comprises at least one stand 50, wherein the at least one stand 50 can be stacked on another of the at least one stand 50, wherein the at least one stand 50 can be disposed on the shoe 60.

As shown in FIG. 7, the operation of the compact angle reference apparatus 10 is different from some of the sharpening guides that are moved along with the movement of a blade when a blade is against a sharpening guide by a user sharpening a blade on a sharpening tool. Instead, in the present invention, a user sharpening a blade 100 on the compact angle reference apparatus 10 can place the blade 100 on the angle guide 200 of the compact angle reference apparatus 10 to get a reference angle initially. The user can use muscle memory to keep the angle consistently and then to move the blade 100 forward along the sharpening surface 110, on which the blade 100 leaving the guide surface 252 of the angle guide 200.

As shown in FIGS. 4, 5, 6 and 7, in one preferred embodiment of the compact angle reference apparatus 10, the base 30 comprises at least one stand 50 and a shoe 60, wherein the shoe 60 further comprises a top 62 and a bottom 64 opposite to the top 62, wherein the at least one stand 50 can be stacked on another of the at least one stand 50, wherein the at least one stand 50 can be disposed on the shoe 60, and wherein shoe 60 can be disposed on a surface 120 adjacent to the sharpening tool 112.

As shown in FIG. 4, in one preferred embodiment of the invention, the stand 50 has a top 52 smaller than a bottom 54 so that a stand 50 can be stacked on another stand 50 securely. There are other methods and configurations that allow stands to be stacked on another stand securely, such as loop and hook fastener, magnets, adhesive materials, etc. A person having ordinary skill in the art will be able to appreciate it.

The benefit of the combination of stands is to provide an adjustable height of the base of the compact angle reference apparatus to fit the various heights of sharpening tools, or to fit a sharpening tool on high or low sharpening holders (not shown). It is a great convenience when the angle guide is located at about the same height with the sharpening surface of sharpening stone.

As shown in FIG. 5, in one preferred embodiment of a compact angle reference apparatus 10, wherein there are two stands 50 having different height stacked together. The benefit of the stacking of the stands 50 having different heights is that the stacking of stands can result in different combinations of heights to fit the various heights of the sharpening tool, like a sharpening stone, and the holder of the sharpening stone.

Having described the subject matter of the present disclosure detailed description of embodiments and examples for purposes of clarity of understanding to a person having ordinary skill in the art that the same can be performed by modifying or changing the subject matter within various conditions, by various structures and by other parameters without affecting its scope or any specific embodiment thereof, and that such modifications or changes are intended to be encompassed within the scope of the claims.

What claimed is:

1. A compact angle reference apparatus for sharpening a blade on a sharpening surface of a sharpening tool comprising: one angle guide; a base; wherein the base further comprises at least two stands; wherein one of the at least two stands is stacked on another one of the at least two stands; wherein the one angle guide is disposed on the base; wherein the one angle guide further comprises a frame having an insert side and a hinge side, a lid having a guide surface, an insert end, and a hinge end opposite to the insert end, a set of hinge pins connecting the hinge side of the frame and the hinge end of the lid in a rotatable manner, an insert having a predetermined height, wherein the insert is movable, wherein the insert is erected between the insert end of the lid and the insert side of the frame, wherein the lid and the frame form an angle between about 0 degrees and 89 degrees by the predetermined height of the insert; wherein the sharpening surface is at a predetermined height; wherein the at least two stands are stacked together to elevate the one angle guide to the sharpening surface at the predetermined height; and wherein the blade is placed on the guide surface of the angle guide to get a reference angle.

2. The compact angle reference apparatus of claim 1, wherein the base further comprises a shoe, wherein the shoe further comprises a top and a bottom opposite to the top, and wherein one of the at least two stands of the base is disposed on the top of the shoe.

3. The compact angle reference apparatus of claim 2, wherein the shoe further comprises an anti-slip material.

4. The compact angle reference apparatus of claim 1, wherein the compact angle reference apparatus is substantially stationary to the sharpening surface when the blade is moved on the sharpening surface.

5. A compact angle reference apparatus for sharpening a blade on a sharpening surface of a sharpening tool comprising: one angle guide; wherein the one angle guide further comprises a frame having an insert side and a hinge side, a lid having a guide surface, an insert end, and a hinge end opposite to the insert end, a set of hinge pins connecting the hinge side of the frame and the hinge end of the lid in a rotatable manner, an insert having a predetermined height, wherein the insert is movable, wherein the insert is erected between the insert end of the lid and the insert side of the frame, wherein the lid and the frame form an angle between about 0 degrees and 89 degrees by the predetermined height of the insert; at least one stand, wherein two or more of the at least one stand can be stacked together when there are two or more of the at least one stand in the compact angle reference apparatus; wherein the one angle guide is disposed on one of the at least one stand; wherein the sharpening surface is at a predetermined height; wherein one or more of the at least one stand is chosen to elevate the one angle guide to the sharpening surface at the predetermined height; and wherein the blade is placed on the guide surface of the angle guide to get a reference angle.

6. The compact angle reference apparatus of claim 5 further comprising: a shoe having a top and a bottom opposite to the top, wherein one of the at least one stand is disposed on the top of the shoe.

7. The compact angle reference apparatus of claim 6, wherein the shoe further comprises an anti-slip material.

8. A compact angle reference apparatus for sharpening a blade on a sharpening surface of a sharpening tool comprising:

one angle guide,
- wherein the one angle guide further comprises
- a frame having an insert side and a hinge side,
- a lid having a guide surface, an insert end, and a hinge end opposite to the insert end,
- a set of hinge pins connecting the hinge side of the frame and the hinge end of the lid in a rotatable manner,
- a slot of the lid formed on the insert end of the lid,
- a slot of the frame formed on the insert side of the frame,
- an insert having a predetermined height,
  - wherein the insert is rectangular,
  - wherein the insert has a top side and a bottom side,
  - wherein the top side of the insert is inserted into the slot of the lid and the bottom side of the insert is inserted into the slot of the frame,
  - wherein the insert is erected between the insert end of the lid and the insert side of the frame,
- wherein the insert is movable,
- wherein the lid and the frame form an angle between about 0 degrees and 89 degrees by the predetermined height of the insert; and at least one stand;

wherein two or more of the at least one stand can be stacked together when there is more than one stand;

wherein the one angle guide is disposed on one of the at least one stand;

wherein the sharpening surface is at a predetermined height; and

- wherein one or more from the at least one stand is chosen to elevate the one angle guide to the sharpening surface at the predetermined height;

wherein the blade is placed on the guide surface of the angle guide to get a reference angle.

9. The compact angle reference apparatus of claim 8 further comprising:

a shoe having a top and a bottom opposite to the top, wherein the angle guide or alternatively the at least one stand can be disposed on the top of the shoe.

10. The compact angle reference apparatus of claim 9, wherein the shoe further comprises an anti-slip material.

* * * * *